US009159508B2

(12) United States Patent
Rival et al.

(10) Patent No.: US 9,159,508 B2
(45) Date of Patent: Oct. 13, 2015

(54) SWITCHGEAR DEVICE HAVING AT LEAST ONE SINGLE-POLE BREAKING UNIT COMPRISING A CONTACT BRIDGE AND CIRCUIT BREAKER COMPRISING ONE SUCH DEVICE

(75) Inventors: Marc Rival, Saint Ismier (FR); Christophe Grumel, Lans en Vercors (FR); Hervé Anglade, Saint Ismier (FR); Jean-Paul Gonnet, Fontaine (FR)

(73) Assignee: Schneider Electric Industries SAS, Rueil-Malmaison (FR)

( * ) Notice: Subject to any disclaimer, the term of this patent is extended or adjusted under 35 U.S.C. 154(b) by 423 days.

(21) Appl. No.: 13/395,263

(22) PCT Filed: Aug. 30, 2010

(86) PCT No.: PCT/FR2010/000592

§ 371 (c)(1),
(2), (4) Date: Mar. 9, 2012

(87) PCT Pub. No.: WO2011/033182

PCT Pub. Date: Mar. 24, 2011

(65) Prior Publication Data

US 2012/0168405 A1 Jul. 5, 2012

(30) Foreign Application Priority Data

Sep. 18, 2009 (FR) ..... 09 04455
Sep. 18, 2009 (FR) ..... 09 04457

(51) Int. Cl.
*H01H 9/34* (2006.01)
*H01H 1/20* (2006.01)

(52) U.S. Cl.
CPC ..... *H01H 9/342* (2013.01); *H01H 1/2058* (2013.01)

(58) Field of Classification Search
CPC ..... H01H 9/34; H01H 9/02; H01H 1/20; H01H 1/97; H01H 73/046; H01H 1/2041; H01H 73/045
USPC ..... 218/15–20, 31, 44–50; 200/243, 244
See application file for complete search history.

(56) References Cited

U.S. PATENT DOCUMENTS 5,281,776 A * 1/1994 Morel et al. ..... 218/152
5,731,561 A 3/1998 Manthe et al.

(Continued)

FOREIGN PATENT DOCUMENTS

EP 1 667 179 A2 6/2006
EP 2 081 202 A2 7/2009

(Continued)

*Primary Examiner* — Amy Cohen Johnson
*Assistant Examiner* — Marina Fishman
(74) *Attorney, Agent, or Firm* — Steptoe & Johnson LLP

(57) ABSTRACT

A switchgear device having a single-pole breaking unit which includes one of a pair of stationary contacts connected to a line-side current conductor, a movable contact bridge for closing and opening the stationary contacts, a line-side panel, a load-side panel opposite the line-side panel and two opposing lateral-side panels, which panels surround the stationary contacts and contact bridge, and form arc extinguishing chambers with a stationary contact within each chamber, an opening volume between chambers, and a quenching gas exhaust channel connected to a chamber, and opening through the line-side panel, which is opposite another load-side panel for contact with a trip device.

13 Claims, 6 Drawing Sheets

(56) References Cited

U.S. PATENT DOCUMENTS

| | | | | |
|---|---|---|---|---|
| 6,037,555 | A | 3/2000 | Castonguay et al. | |
| 6,573,815 | B1 * | 6/2003 | Tsukima et al. | 218/22 |
| 8,063,334 | B2 | 11/2011 | Dahl | |
| 2005/0046539 | A1 * | 3/2005 | Ciarcia et al. | 337/16 |
| 2009/0194510 | A1 * | 8/2009 | Dahl | 218/46 |

FOREIGN PATENT DOCUMENTS

| | | |
|---|---|---|
| WO | WO 99/14776 | 3/1999 |
| WO | WO 2009/065706 A2 | 5/2009 |

* cited by examiner

SWITCHGEAR DEVICE HAVING AT LEAST ONE SINGLE-POLE BREAKING UNIT COMPRISING A CONTACT BRIDGE AND CIRCUIT BREAKER COMPRISING ONE SUCH DEVICE

This application is a national stage entry of International Application No. PCT/FR2010/000592, filed Aug. 30, 2010 designating the U.S., which claims the benefit of French Application No. 09/04455, filed Sep. 18, 2009, and French Application No. 09/04457, filed Sep. 18, 2009.

BACKGROUND OF THE INVENTION

The invention relates to a switchgear device having at least one single-pole breaking unit. Said unit comprises a movable contact bridge, a pair of stationary contacts operating in conjunction with said movable contact bridge and respectively connected to a current input conductor. Said unit comprises two arc extinguishing chambers respectively opening onto an opening volume of the contact bridge.

The invention also relates to a circuit breaker comprising a switchgear device.

STATE OF THE ART

Removal of the quenching gases in an electric switchgear apparatus, in particular a circuit breaker comprising at least one arc extinguishing chamber, is generally achieved by placing an outlet hole directly on a rear surface of the arc extinguishing chamber. The gases generated at the time breaking takes place pass through the extinguishing chamber, are cooled when they come into contact with one or more deionizing fins and are removed at the rear of the arc extinguishing chamber via an opening. A grate preferably associated with additional filtering means enables the gases to be removed to the outside of the switchgear apparatus while at the same time stopping a large number of molten metallic particles. In spite of these usual precautions, the gases remaining strongly ionized are very polluting. This pollution can in particular damage the electronic trip means of the switchgear apparatus when they are placed in proximity to the outlet grate of an arc extinguishing chamber. Furthermore, when the gases are removed to an area close to a current input conductor in the switchgear apparatus, electric arc flashover phenomena during quenching may be observed.

To remedy these problems, certain solutions in particular described in the document U.S. Pat. No. 5,731,561, or in a Patent EP1667179 of the applicant, eliminate any removal of the quenching gases to the outside of the circuit breaker. A switchgear apparatus without external manifestation is then referred to. The arc extinguishing chambers are connected to gas flow channels inside the switchgear device. More or less long routing of the quenching gases inside a closed volume theoretically enables sufficient cooling of the gases. These solutions do however present the drawback of generating very high pressures inside the case of the switchgear device. The quenching gases confined during cooling thereof do in fact generate large over-pressures inside the case, over-pressures which may lead to explosion of the case of the switchgear device. Dimensioning of the walls of the case and global design of the latter then have to be performed taking these new constraints into account.

SUMMARY OF THE INVENTION

The object of the invention is therefore to remedy the shortcomings of the state of the art so as to propose a switchgear device comprising efficient means for removing the quenching gases.

Each extinguishing chamber of the switchgear device according to the invention is connected to at least one quenching gas exhaust channel, said exhaust channels opening onto a line-side panel of the case of the breaking unit, said line-side panel being positioned opposite another load-side panel designed to be placed in contact with trip means.

According to a mode of development, said quenching gas exhaust channels are joined to form a common duct opening onto the line-side panel of the case of the breaking unit.

Advantageously, the quenching gas exhaust channels respectively of a first and second extinguishing chamber are of different lengths, the quenching gases flowing in a first gas exhaust channel being designed to suck the gases flowing in a second channel by Venturi effect.

Preferably, each arc extinguishing chamber comprises a stack of at least two deionizing fins separated from one another by a gas exchange space, at least one exchange space being connected to a quenching gas exhaust channel.

According to a particular embodiment, said at least one gas exhaust channel of an arc extinguishing chamber passes through at least one decompression chamber comprising at least one wall covered by a metal sheet.

Advantageously, the decompression chamber is positioned under a bottom wall of the arc extinguishing chamber, the wall covered by the metal sheet being in a plane forming an angle comprised between 45° and 140° with respect to the direction of flow of the gases.

Advantageously, the wall covered by the metal sheet is in a plane perpendicular to the direction of flow of the gases.

Advantageously, a gas exhaust channel comprises a rotary valve designed to be driven in rotation by the flow of the quenching gases, rotation of the valve from a first position to a second position being designed to actuate trip means to bring about opening of the contacts of the switchgear device.

According to a particular embodiment, the movable contact bridge is rotary and is positioned in a rotary bar having a transverse hole accommodating said contact bridge, which is salient on each side of the bar, said rotary bar being fitted between two side panels of the case of the breaking unit, two sealing flanges being placed respectively between the radial surfaces of the rotary bar and the side panels so as to ensure tightness between the inside and the outside of the breaking unit.

Preferably, the rotary bar comprises at least one channel in direct connection between the transverse accommodating hole and a radial surface so that the quenching gases can flow directly via said channel to at least one sealing flange in order to push it against one of the side panels to achieve tightness.

Advantageously, said channel is pass-through and passes right through the rotary bar from a first radial surface to a second radial surface, said pass-through channel comprising a longitudinal axis parallel to a longitudinal axis of the rotary bar.

Advantageously, the pass-through channel comprises a longitudinal axis aligned with a longitudinal axis of the rotary bar so that the quenching gases can exert a thrust force substantially aligned with the longitudinal axis of the bar and distributed uniformly on the sealing flanges.

Preferably, the sealing flanges comprise lateral cheeks at least partially covering the longitudinal surface of the rotary bar to partially close the transverse hole accommodating the bar.

Preferably, the movable contact bridge is rotating in the clockwise direction between an open position and a closed position of the contacts.

The invention relates to a circuit breaker comprising a switchgear device as defined in the foregoing. Said circuit breaker comprises a trip device connected to the load-side terminal strips of the switchgear device.

BRIEF DESCRIPTION OF THE DRAWINGS

Other advantages and features will become more clearly apparent from the following description of a particular embodiment of the invention, given for illustrative and in no way restrictive example purposes only, represented in the appended drawings in which.

DETAILED DESCRIPTION OF AN EMBODIMENT

Figure 1:
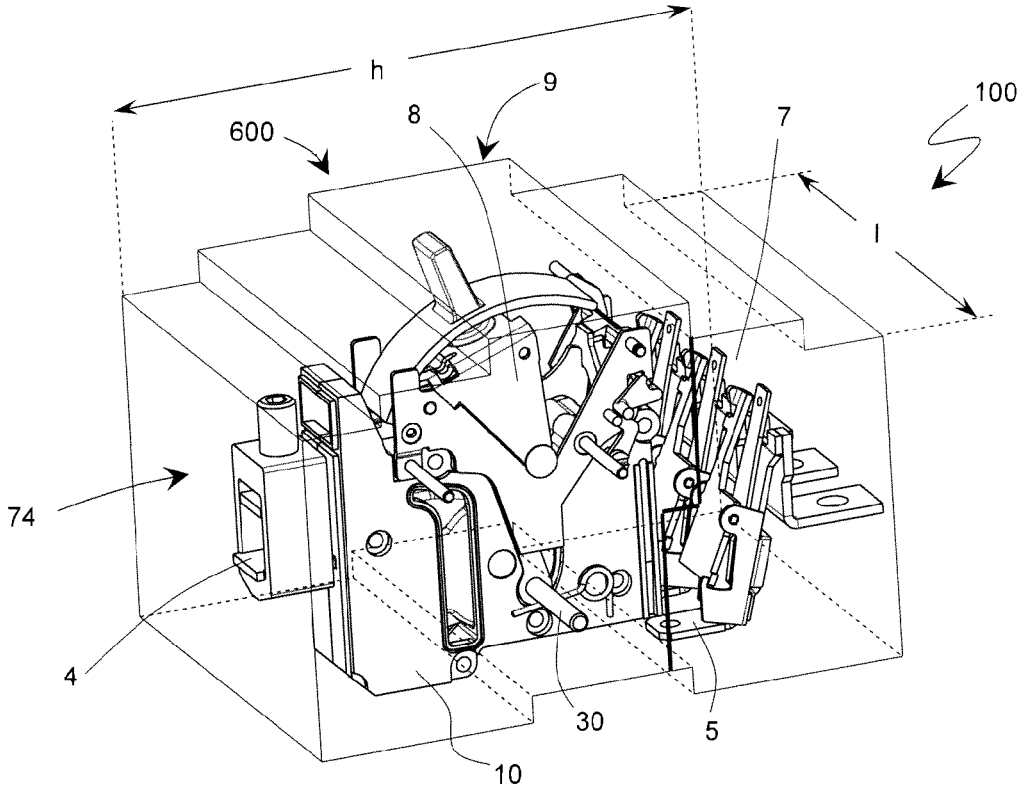
FIG. 1 represents an overview of a circuit breaker comprising a switchgear device according to an embodiment of the invention.

According to an embodiment of the invention, the switchgear apparatus 100, generally a circuit breaker, comprises a trip device 7 associated with a switchgear device 600.

The switchgear device 600 comprises at least one single-pole breaking unit 10. The single-pole breaking unit is connected on the one hand to the trip device 7 at the level of the load-side terminal strip 5, and on the other hand to a current line to be protected at the level of a line-side terminal strip 4. The single-pole breaking unit 10 is also called cartridge.

Figure 2A:
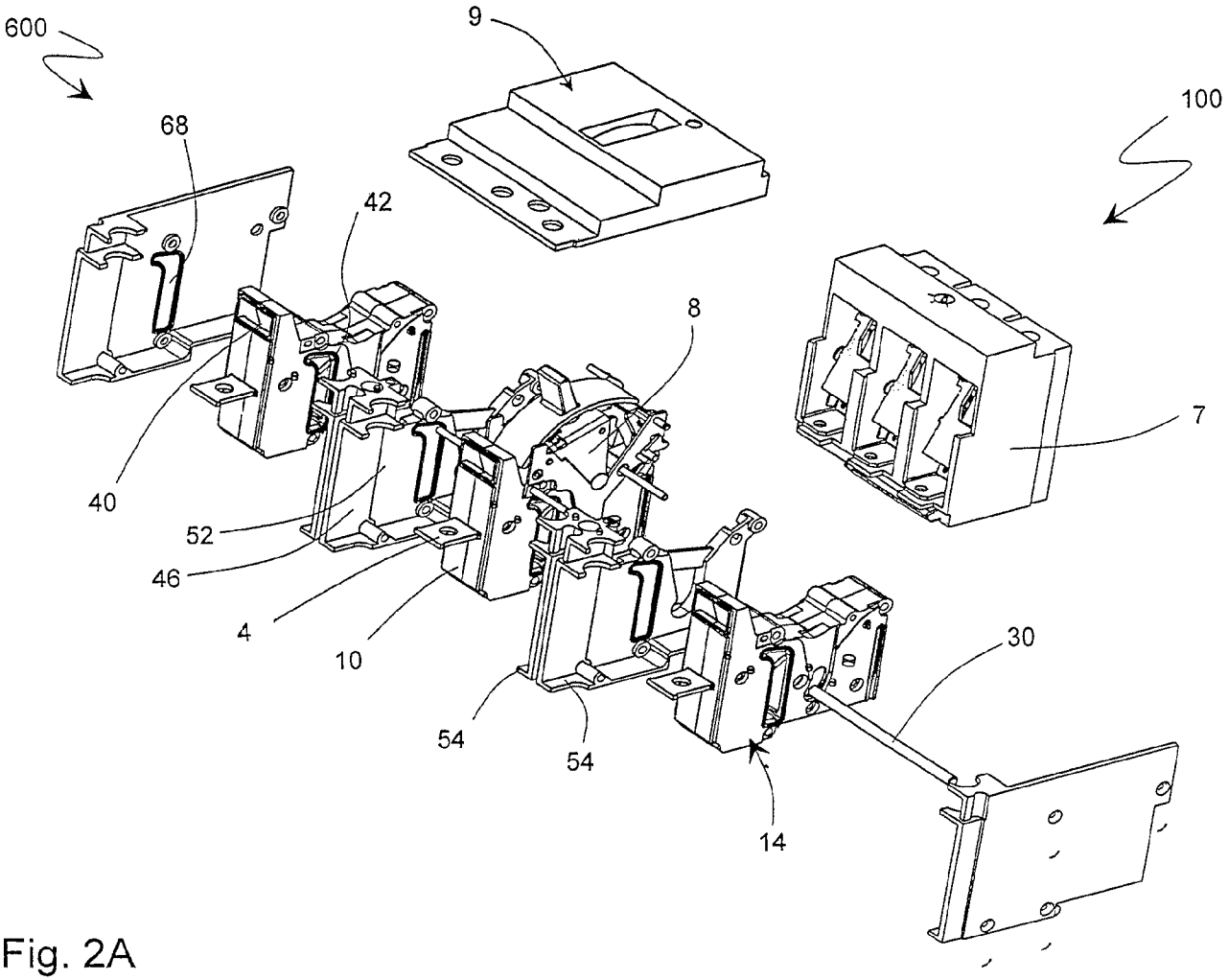
FIG. 2A represents an exploded perspective view of a circuit breaker comprising a switchgear device according to an embodiment of the invention.

According to a preferred embodiment of the invention as represented in FIG. 2A, the switchgear device 600 comprises three single-pole breaking units. The switchgear apparatus 100 is then a three-pole circuit breaker. According to other embodiments which are not represented, the switchgear apparatus could be a single-pole, two-pole or four-pole circuit breaker.

With a concern for simplification of presentation of a preferred embodiment of the invention, the elements composing the switchgear apparatus 100, and in particular the single-pole breaking units 10 forming the switchgear device 600, will be described in relation with the position of use in which the circuit breaker 100 is fitted in place in a panel, with the nose 9 comprising a vertical handle parallel to the mounting panel, the line-side connection terminal strips 4 on the electric line located at the top and forming the top surface 74 of the switchgear device 100 and the trip device 7 at the bottom. The use of the relative position terms such as "lateral", "top", "bottom", etc. should not be interpreted as a limiting factor. The handle is designed to command an actuating mechanism 8 of the electric contacts.

Each single-pole breaking unit 10 enables a single pole to be interrupted. Said unit is advantageously in the form of a flat case 12 made from moulded plastic, with two parallel large panels 14 separated by a thickness e. In particular, in the illustrated embodiment, the thickness e is about 23 mm for a 160 A rating.

The case 12 is formed by two parts, which preferably present mirror symmetry, secured to one another via their large panels 14 by any suitable means. As illustrated in a preferred embodiment in FIG. 3, a complementary system of tenon and mortar type enables the parts of case 12 to be adjusted to fit one another, one of the two parts (not shown) comprising suitable prongs to enter recesses of the other part. Arrangements 18 are furthermore provided to enable juxtaposition of the cases 12 of the single-pole unit 10 and securing of the latter for a multipole circuit breaker 100.

The single-pole breaking unit comprises a breaking mechanism 20 housed in the case 12. According to a particular embodiment illustrated in FIGS. 4 to 7, the breaking mechanism 20 is preferably of double rotary breaking type. The switchgear apparatus 100 according to the invention is in fact particularly intended for applications up to 630 A, and in certain applications up to 800 A, for which single breaking may not be sufficient.

The breaking mechanism 20 comprises a movable contact bridge 22 comprising a contact strip at each end. The breaking unit comprises a pair of stationary contacts 41, 51. Each stationary contact is designed to operate in conjunction with a contact strip of the movable contact bridge 22. A first stationary contact 41 is designed to be connected to the current line by a line-side terminal strip 4. A second stationary contact 51 is designed to be connected to the trip device 7 by a load-side terminal strip 5. Each part of case 12 comprises a corresponding passage recess. Said bridge is mounted between an open position in which the contact strips are separated from the stationary contacts 41, 51 and a current flow position in which they are in contact with each of the stationary contacts.

Figure 4:
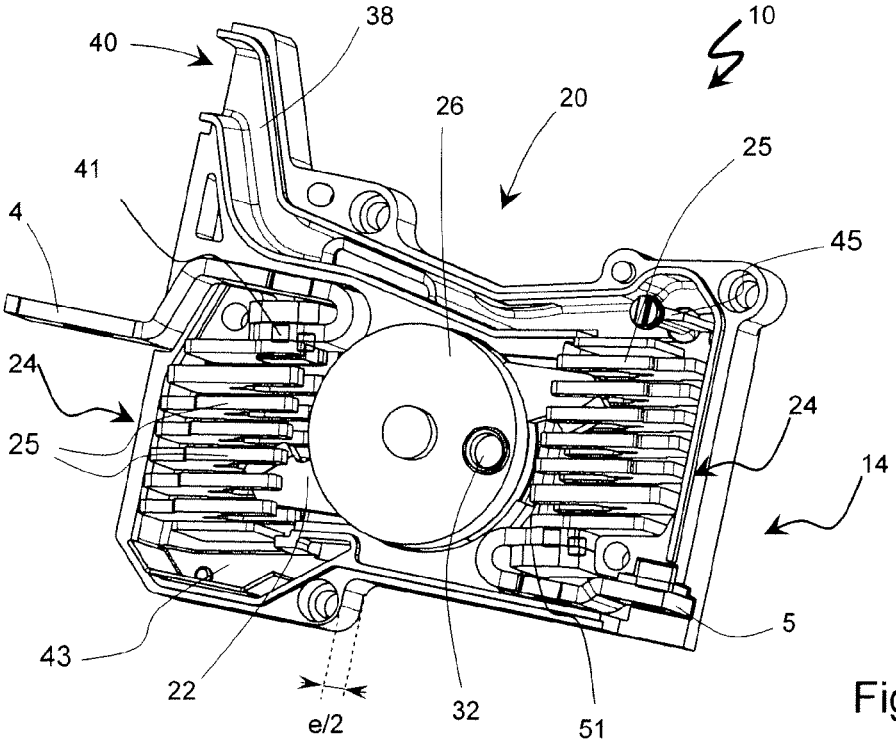
Figure 5:
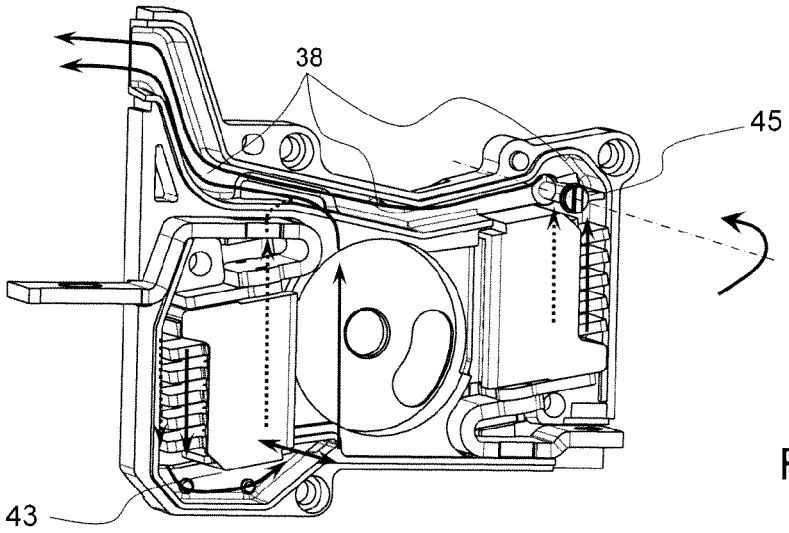
Figure 6:
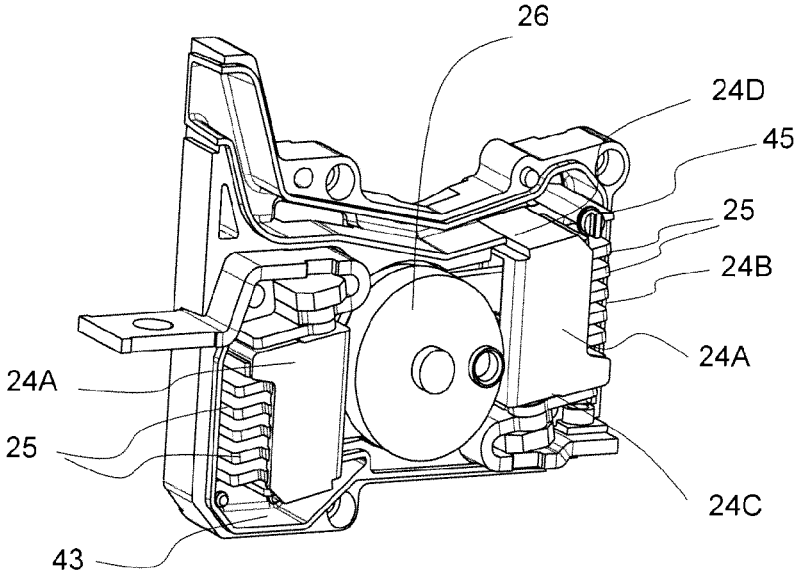

The single-pole breaking unit 10 comprises two arc extinguishing chambers 24 for quenching electric arcs. Each extinguishing chamber 24 opens onto an opening volume between a contact strip of the contact bridge 22 and a stationary contact. Each extinguishing chamber 24 is delineated two side walls 24A, a rear wall 24B at a distance from the opening volume, a bottom wall 24C close to the stationary contact, and a top wall 24D. As represented in FIGS. 4 to 6, each extinguishing chamber 24 comprises a stack of at least two deionizing fins 25 separated from one another by an exchange space of the quenching gases.

According to a preferred embodiment, the case 12 of the breaking unit 10 further comprises arrangements for optimization of the gas flow. Each arc extinguishing chamber 24 comprises at least one outlet connected to at least one quenching gas exhaust channel 38, 42. Said exhaust channels 38, 42 are designed to remove the gases via at least one pass-through hole 40 positioned on a line-side panel of the case 12 positioned opposite the other load-side panel. The load-side panel of the case 12 is designed to be placed in contact with the trip device 7.

Each arc extinguishing chamber 24 preferably comprises at least one exchange space between two fins 25 connected to a gas exhaust channel 38, 42. All the exchange spaces are preferably connected to the gas exhaust channels 38, 42 at the level of an area at a distance from the volume opening onto the rear wall and at the level of the side walls of the arc extinguishing chamber 24.

According to a particular embodiment, the movable contact bridge 22 is rotary around an axis of rotation Y. The contact strips of said bridge are preferably placed symmetrically with respect to the axis of rotation Y. The movable contact bridge 22 is mounted floating in a rotary bar 26 having a transverse hole accommodating said contact bridge. The movable contact bridge 22 passing through the transverse accommodating hole is salient on each side of the bar 26. Said rotary bar 26 is fitted between the two side panels 14 of the case 12 breaking unit 10. Furthermore, according to this embodiment, assembly of the contact bridge 22 and of the rotary bar 26 in a single-pole breaking unit 10 is "reversed". It is desired for the handle 9 of the contact actuating mechanism (see FIGS. 1 and 2A) to be centred on the switchgear device 600 of the circuit breaker 100 in operation, the protective front panel of the electric line protection devices then being able to be symmetrical. For this purpose, inversion of the direction of rotation of the bar 26 has been chosen, i.e. the connection terminal strip 5 to the trip device 7 is located towards the rear of the circuit breaker 100 and the line-side connection terminal strip 4 is towards the front, at the top. Thus, as represented in FIG. 4, the movable contact bridge 22 is rotary in the clockwise direction between an open position and a closed position of the contacts. Thus, in this preferred embodiment in which the direction of rotation of the rotary contact bridge is reversed, gas exhaust from the contact connected to the load-side terminal strip 5, which should in traditional manner be directed downwards and towards the rear of the apparatus, is displaced to the top and the front of the breaking unit 10. The area located at the rear and at the bottom of the apparatus corresponds to an area in which the trip device 7 and any fixing supports that may exist such as in particular a DIN rail are placed. In particular, the substantially rectangular shape of the enclosure of the case 12 of the breaking unit 10 is extended on the front side by a first gas exhaust channel 38. Said first channel enables the quenching gases to be directed from the load-side terminal strip 5 coupled with the trip device 7 to the top part of the switchgear apparatus 100. The quenching gases are removed to the outside of the case via a pass-through hole 40. The positioning of the pass-through hole 40 in the top part of the switchgear device and in particular above the line-side terminal strip 4 also reduces the risks of arc flashovers.

Furthermore, the exhaust gases emanating from the contact 41 connected to the line-side terminal strip 4 are advantageously also directed upwards and towards the front of the breaking unit 10 via at least one second exhaust channel 42. In particular, said at least one exhaust channel 42 is at least partially positioned in the parallel large panels 14 of the case 12 of the breaking unit 10.

Figure 3:
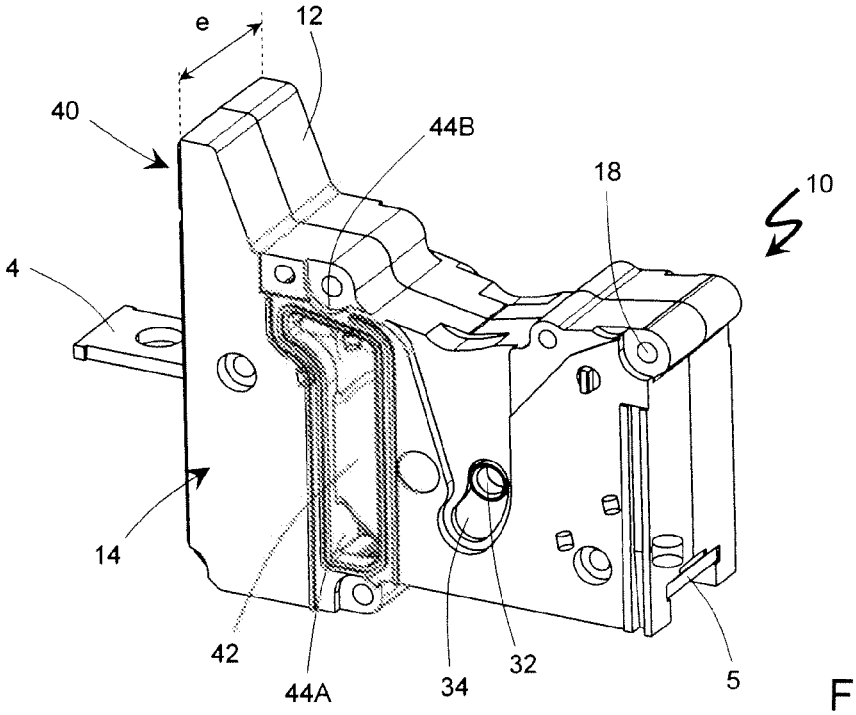
FIGS. 3 to 7 show perspective views of a single-pole breaking unit and a part of its case for a switchgear device according to a preferred embodiment of the invention.

As represented in FIGS. 3 and 5, according to a mode of development, two lateral exhaust channels 42 are arranged partially outside the case 12 of the breaking unit 10. These two channels are connected to one and the same extinguishing chamber 24. Each lateral exhaust channel 42 is connected to the inside of the case 12 by two holes 44A, 44B. The external part of the lateral exhaust channel 42 can preferably be hollowed out in the wall of the case 12.

Figure 2B:
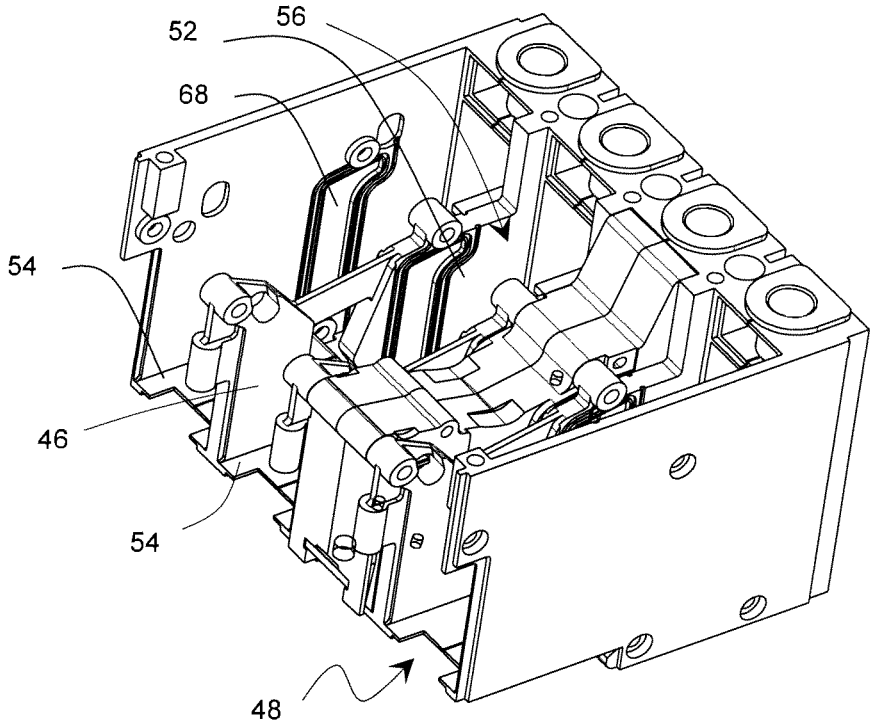
FIG. 2B represents a perspective view of a switchgear device in the course of assembly according to an embodiment of the invention.

As, according to a particular embodiment of the invention as described in particular in French Patent application filed on this day in the name of the Applicant and entitled: "Functional spacer for separating the cartridges in a multipole switchgear device and circuit breaker", the single-pole units 10 are assembled by means of spacers 46 to form a double enclosure 48. It is advantageous to take advantage of this architecture to integrate each lateral exhaust channel 42 partly in the spacer 46. In particular, as illustrated in FIGS. 2A and 2B, the spacers 46 are made from moulded plastic and mainly comprise a central partition 52 designed to be parallel to the large panels 14 of the breaking units 10. Juxtaposition of two spacers 46 thus defines a cavity 56 in which a single-pole breaking unit 10 is housed. Advantageously, two opposite bottom edges 54 of each spacer 46 close the cavity 56 at the rear thereof in substantially tightly sealed manner when clamping of the spacers 46 on one another is performed. Each spacer 46 comprises arrangements enabling the second lateral exhaust channels 42 for outlet of the gases to be partially defined. Advantageously, each lateral exhaust channel 42 is partially etched in the external large panel 14 of the case 12 of the cartridge 10, between the two outlet holes 44A, 44B and a corresponding element 68, etching and/or salient contour, on the central partition 52. When juxtaposition and clamping of the spacer 46 are performed on the cartridge 10, the gases can then be directed from the outlet hole 44A to the top hole 44B along the partition 52.

The single-pole breaking units 10 are designed to be driven simultaneously and are coupled for this purpose by least one rod 30, in particular at the level of the bar 26, and for example by holes 32 forming the limiting stops of the movable contact bridge 22. According to a preferred embodiment, a single drive rod 30 is used and each part of case 12 comprises a hole 34 in the form of an arc of a circle enabling at least mobilization of the rod 30 passing through the latter between the current flow position and the open position.

Figure 7:
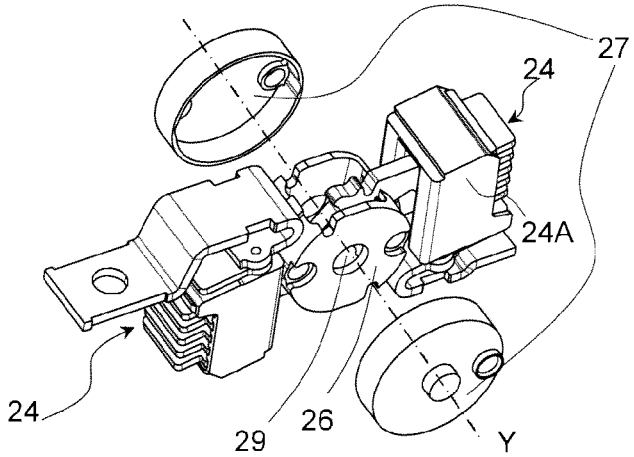

According to a particular embodiment of the invention as represented in FIGS. 5 to 7, said at least second gas exhaust channel 42 passes through at least one decompression chamber 43 comprising at least one wall covered by a metal sheet 85.

The inner wall covered by said sheet preferably forms part of a decompression chamber 43. This metal sheet 85 constitutes a particle trap which serves the purpose on the one hand of capturing the metallic particles originating from breaking in order to thermally protect the plastic parts situated downstream from the trap, and also to reduce the temperature of the quenching gases. The particle trap further protects the plastic parts of the channel situated behind said at least one metal sheet 85 and enhances the tightness of the sealing surface of the case 12.

The use of at least one metal sheet 85 at least partially covering the inner wall of the gas exhaust channel enables good capture of the molten steel and copper balls resulting from erosion of the separators, contacts and conductors when current breaking takes place. Said at least one metal sheet comprises a thickness to prevent the molten balls from piercing it right through. The minimum thickness is preferably comprised between 0.3 and 3 mm and is to be adjusted according to the breaking energy of the product.

Said at least one metal sheet 85 is made from steel, copper or an iron-based alloy.

Figures 8A, 8B:
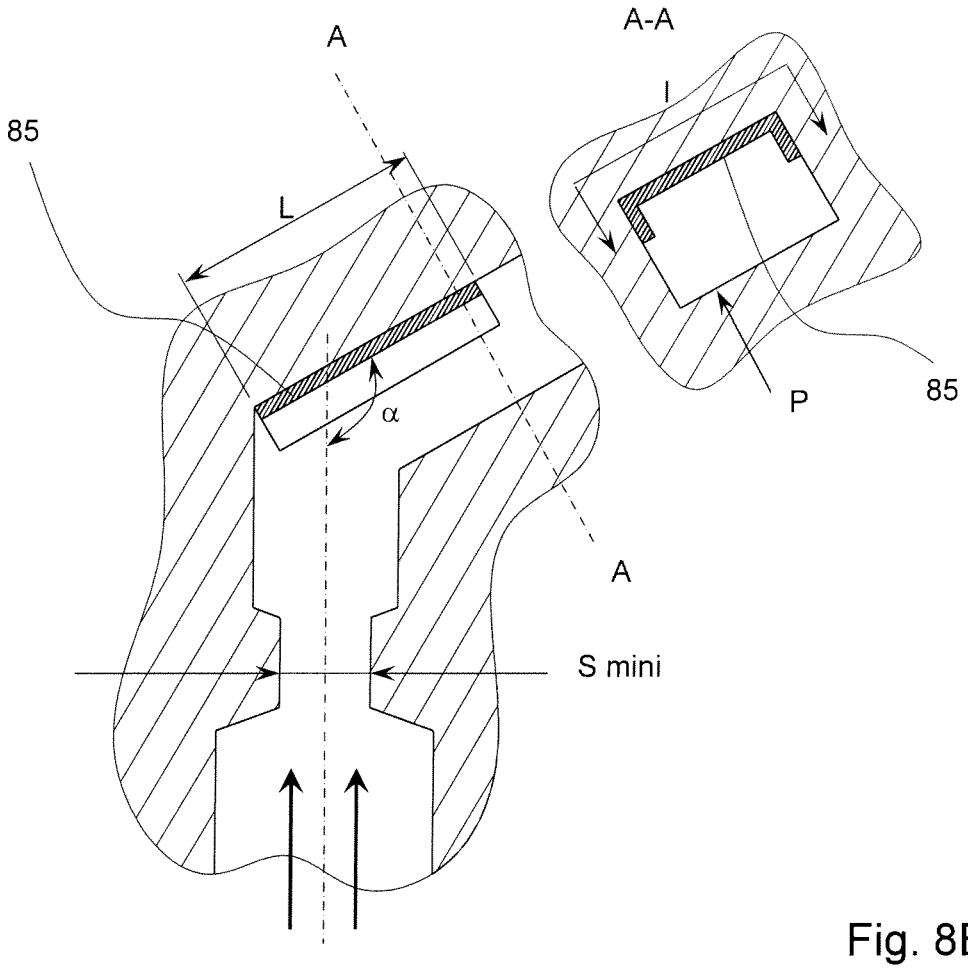
FIGS. 8A and 8B show detailed cross-sectional views of a gas exhaust channel of a breaking unit according to the invention.

As represented in FIG. 8A, the inner wall of the exhaust channel covered by said at least one metal sheet 85 of the particle trap forms an angle $\alpha$ comprised between 45° and 140° with respect to the direction of flow of the gases. The wall supporting said at least one metal sheet is preferably in a plane perpendicular to the direction of flow of the quenching gases ($\alpha$=90°). In practice, by placing said at least one metal sheet 85 in a curve or in the exit of a curve of the gas flow, pressing and adhesion of the particles against the sheet are promoted due to centrifugal force.

Said at least one metal sheet 85 at least partially covers the inner surface of the exhaust channel. The metal sheet extends along the longitudinal axis of the channel. The total length L of inner wall covered by said at least one metal sheet 85 in the direction of flow is at least equal to the square root of the smallest cross-section of flow S of the channel measured upstream from said sheet. The largest possible length is desirable to reduce the temperature of the gases. The required minimum length is expressed according to the following equation:

$$L \geq \sqrt{S}\min$$

with 5 min the surface of the minimum cross-section of the exhaust channel.

Said at least one metal sheet 85 further extends on the internal perimeter P of the exhaust channel in a perpendicular direction to the gas flow direction. The required minimum distance I over which said sheet extends is expressed according to the following equation:

$$Pm/10 \leq I \leq Pm$$

Pm being the mean perimeter of the gas exhaust channel in which the particle trap is situated.

Said decompression chamber is preferably positioned as close as possible to the outlet of the arc extinguishing chamber. According to a particular embodiment, the decompression chamber is placed under the bottom wall of the arc extinguishing chamber 24.

According to a mode of development of the invention represented in FIGS. 4 and 5, all the gas exhaust channels 38, 42 join one another in a common duct opening onto the line-side panel of the case 12 of the breaking unit 10. The quenching gases are then removed via a single pass-through hole 40. As an example embodiment, the routing of the quenching gases inside the exhaust channels is represented in FIG. 5. The gases generated at the time breaking takes place in the two extinguishing chambers 24 are thus advantageously directed away from the trip device 7 and from the possible fixing supports such as for example a DIN rail.

According to a first alternative embodiment, the gas exhaust channels 38 and 42 respectively of a first and second extinguishing chamber 24 are of different lengths, the quenching gases flowing in a first gas exhaust channel being designed to suck the gases flowing in a second channel by Venturi effect.

According to a second alternative embodiment, a gas exhaust channel 38 comprises a rotary valve 45 designed to be driven in rotation by flow of the quenching gases. Rotation of the valve from a first position to a second position is designed to actuate trip means of the switchgear apparatus to bring about opening of the contacts.

Advantageously, each part of the case 12 is moulded with internal arrangements enabling a relatively stable positioning of the different elements composing the breaking mechanism 20, in particular two symmetrical housings for each of the extinguishing chambers 24, and a circular central housing for fitting the bar 26.

According to a mode of development of the invention, two sealing flanges 27 are respectively placed between the radial surfaces of the rotary bar 26 and the side panels 14 to ensure tight sealing between the inside and the outside of the breaking unit 10. For example purposes, on account of the shape of the rotary bar, the sealing flanges 27 are of cylindrical shape and can be in the form of a washer. As, according to a particular embodiment of the invention as described in particular in French Patent application filed on this day in the name of the Applicant and entitled: "Single-pole breaking unit comprising a rotary contact bridge, switchgear device comprising such a unit and circuit breaker comprising such a device", the rotary bar 26 comprises at least one channel 29 in direct connection between the transverse accommodating hole and a side panel 14 so that the quenching gases can flow directly via said channel to at least one sealing flange 27 in order to push them against one of the side panels 14 to achieve tight sealing.

As represented in FIG. 7, the channel 29 of the rotary bar 26 is preferably pass-through and passes right through the rotary bar 26 from a first radial surface to a second radial surface. Said pass-through channel 29 comprises a longitudinal axis parallel to a longitudinal axis of the rotary bar 26. Furthermore, the pass-through channel 29 preferably comprises a longitudinal axis aligned with a longitudinal axis of the rotary bar 26 so that the quenching gases can exert a thrust force substantially aligned with the longitudinal axis of the bar and uniformly distributed on the sealing flanges.

According to a particular embodiment of the sealing flanges 27 represented in FIG. 7, said flanges comprise lateral cheeks at least partially covering the longitudinal surface of the rotary bar 26 to partially close the transverse hole accommodating the bar 26.

The circuit breaker 100 according to the invention obtained in this way enables the following industrial requirements that are at first sight antinomic to be complied with as best as possible:

- the same architecture can be used for the whole range up to 800 A due to the use of double breaking with movable contact bridge 22;
- the dependability of the breaking mechanisms 20 and optimization of the latter are ensured by the use of well-proven solutions;
- the trip device 7 can be connected via the bottom to the load-side terminal strip of the switchgear device 600, thereby giving better accessibility to the connecting screws due to reversal of the direction of rotation of the rotary contact breaking bridge 22;
- interchangeability of the trip devices 7 is complete enabling greatly delayed differentiation of the switchgear apparatuses 100;
- the nose 9 of the switchgear device 600 is centred, in particular at 42.5 mm, due to reversal of the direction of rotation in the breaking units 10, enabling symmetrical front cover plates to be used in the cabinets;
- the quenching gases are not removed next to the trip device 7, thereby limiting pollution on this element which may be sensitive, in particular in its electronic version, and freeing space;
- outlet of the quenching gases is no longer performed under the connections 4, 5 of the circuit breaker 100, thereby limiting the risks of arc flashovers on breaking.

The invention claimed is:

1. An electrical switchgear device (600), comprising:

at least one single-pole breaking unit (10), said single-pole breaking unit comprising:

a case (12) having a line-side panel, and a load-side panel located opposite said line-side panel;

a pair of stationary contacts (41, 51), one of which stationary contacts is connected to a load-side terminal strip (5) extending outwardly from the load-side panel, the other stationary contact being connected to a line-side terminal strip (4) extending outwardly from the line-side panel;

a movable contact bridge (22) for movement into and out of contact with said stationary contacts;

said case enclosing an opening volume between two are extinguishing chambers (24, 24), with said movable contact bridge (22) located within said opening volume, and each extinguishing chamber (24) is in communication with a quenching gas exhaust channel (38, 42), which is situated inside the case of the single-pole breaking unit (10), said exhaust gas channel opening through the line-side panel of the case (12), said exhaust gas channel (38) being above and in a common plane with said contact bridge (22), said exhaust gas channel (38) enabling quenching gases to be directed from load-side terminal strip (5) to a top part of the switch gear apparatus, said exhaust gas channel (38) also being in communication with an exhaust pass-through hole (40) in a top portion of the line-side panel above line-side terminal strip (4).

2. The switchgear device according to claim 1, wherein said quenching gas exhaust channel joins a common duct opening through the line-side panel.

3. The switchgear device according to claim 2, wherein one of said quenching gas exhaust channels, respectively, vents each of said arc-extinguishing chambers, and said chambers are of different lengths, so that the quenching gases flowing in a first exhaust channel promote evacuation of gases flowing in a second exhaust channel by Venturi effect.

4. The switchgear device according to claim 1, wherein each are extinguishing chamber comprises a stack of at least two deionizing fins separated from one another by a gas exchange space, at least one of said exchange spaces being connected to said quenching gas exhaust channel.

5. The switchgear device according to claim 1, wherein at least one gas exhaust channel opens through at least one decompression chamber comprising at least one wall covered by a metal sheet.

6. The switchgear device according to claim 5, wherein the breaking unit additionally comprises a bottom wall of an arc extinguishing chamber, and the decompression chamber is positioned under said bottom wall, and the wall covered by the metal sheet is in a plane forming an angle between 45° and 140° to the direction of flow of gases exhausting through the decompression chamber.

7. The switchgear device according to claim 6, wherein the wall covered by the metal sheet is in a plane perpendicular to the direction of flow of the gases.

8. The switchgear device according to claim 1, wherein said gas exhaust channel includes a rotary valve for being driven in rotation by flow of quenching gases, rotation of the valve from a first position to a second position for actuating a trip means device for opening the contacts of the switchgear device.

9. The switchgear device according to claim 1, wherein the movable contact bridge is rotary, is positioned in a rotary bar and is salient on each side of the bar.

10. The switchgear device according to claim 9, wherein the movable contact bridge is rotary in the clockwise direction between an open position and a closed position of the contacts.

11. A circuit breaker comprising a switchgear device according to claim 1, additionally comprising a load-side terminal strip extending through said load-side panel and connected to one of said stationary contacts.

12. The switchgear device according to claim 9, wherein the rotary bar comprises two substantially parallel radial side disks, and a pair of sealing flanges each of which is located between one of said side disks and an adjacent lateral side panel for ensuring sealing of the breaking unit.

13. The switchgear device according to claim 11, additionally comprising a trip device connected to said load-side terminal strips.

* * * * *